US008668323B2

(12) United States Patent
Onishi

(10) Patent No.: US 8,668,323 B2
(45) Date of Patent: Mar. 11, 2014

(54) PRINTING DEVICE AND PRINTING METHOD

(75) Inventor: Hiroyuki Onishi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 408 days.

(21) Appl. No.: 12/882,462

(22) Filed: Sep. 15, 2010

(65) Prior Publication Data

US 2011/0096130 A1 Apr. 28, 2011

(30) Foreign Application Priority Data

Oct. 28, 2009 (JP) ..... 2009-248111

(51) Int. Cl.
*B41J 2/01* (2006.01)
*B41J 29/38* (2006.01)
*B41J 2/155* (2006.01)

(52) U.S. Cl.
USPC ..... 347/102; 347/6; 347/42

(58) Field of Classification Search
None
See application file for complete search history.

(56) References Cited

U.S. PATENT DOCUMENTS 7,244,021 B2 7/2007 Arai
7,510,277 B2 * 3/2009 Konno et al. ..... 347/102
2004/0189772 A1 * 9/2004 Arai ..... 347/102
2008/0079795 A1 4/2008 Nakazawa
2008/0225100 A1 9/2008 Kumagai
2009/0085999 A1 * 4/2009 Furukawa ..... 347/102
2009/0167794 A1 * 7/2009 Hosono et al. ..... 347/6
2011/0096131 A1 4/2011 Onishi

FOREIGN PATENT DOCUMENTS

JP 2000-158793 A 6/2000
JP 2004-306591 A 11/2004
JP 2005-193645 A 7/2005
JP 2005-199563 A 7/2005
JP 2006-088529 A 4/2006
JP 2008-221650 A 9/2008

* cited by examiner

*Primary Examiner* — Stephen Meier
*Assistant Examiner* — Alexander C Witkowski
(74) *Attorney, Agent, or Firm* — Nutter McClennen & Fish LLP; John J. Penny, Jr.; Christina M. Sperry

(57) ABSTRACT

Disclosed herein is a printing device including: a plurality of heads configured to discharge inks cured by light irradiation and arranged in a transport direction of a medium; a plurality of pre-curing light sources provided in correspondence with the plurality of heads and configured to irradiate pre-curing light to dots formed on the medium by the heads; and a completely-curing light source configured to irradiate completely-curing light to the dots to which the light from the plurality of pre-curing light sources is irradiated, wherein a first printing mode in which a background ink is discharged from a head of an upstream side of the transport direction of the heads for discharging color inks and a second printing mode in which the background ink is discharged from a head of a downstream side of the transport direction of the heads for discharging the color inks are present.

16 Claims, 10 Drawing Sheets

| HEAD | 31a | 31b | 31c | 31d | 31e | 31f |
|---|---|---|---|---|---|---|
| FRONT PRINTING MODE | W | K | Y | M | C | B |
| BACK PRINTING MODE | K | Y | M | C | B | W |

| HEAD | 31a | 31b | 31c | 31d | 31e | 31f |
|---|---|---|---|---|---|---|
| INK COLOR | W | K | Y | M | C | W |
| FRONT PRINTING MODE | ○ | ○ | ○ | ○ | ○ | × |
| BACK PRINTING MODE | × | ○ | ○ | ○ | ○ | ○ |

PRINTING DEVICE AND PRINTING METHOD

CROSS REFERENCES TO RELATED APPLICATIONS

The present invention contains subject matter related to Japanese Patent Application No. 2009-248111 filed in the Japanese Patent Office on Oct. 28, 2009, the entire contents of which are incorporated herein by reference.

BACKGROUND

1. Technical Field

The present invention relates to a printing device and a printing method.

2. Related Art

A printing device for performing printing using a liquid (for example, a UV ink) cured by irradiation of a light (a kind of an electromagnetic ray, for example, an ultraviolet (UV) ray) is known. In such a printing device, an ink is discharged from nozzles of a head onto a medium and then the light is irradiated to the dots formed on the medium. Then, the dots are cured and fixed to the medium, and thus good printing is performed with respect even to a medium which hardly absorbs liquid (for example, see JP-A-2000-158793).

As the above-described printing device, a printing device for performing 2-step curing is proposed. For example, just after dots are formed, a light with weak irradiation energy is irradiated so as to suppress blurring between inks or enlargement of dots (pre-curing). Thereafter, a light with strong irradiation energy is irradiated to the pre-cured dots. Accordingly, the dots are completely cured (completely-curing).

However, in such a printing device, if a background image is printed using a background ink (for example, a white ink) and the background ink is always pre-cured under the same condition, image quality may deteriorate.

SUMMARY

An advantage of some aspects of the invention is that image quality is improved.

According to an aspect of the invention, there is provided a printing device including: a plurality of heads configured to discharge inks cured by light irradiation and arranged in a transport direction of a medium; a plurality of pre-curing light sources provided in correspondence with the plurality of heads and configured to irradiate pre-curing light to dots formed on the medium by the heads; and a completely-curing light source configured to irradiate completely-curing light to the dots to which the light from the plurality of pre-curing light sources is irradiated, wherein a first printing mode in which a background ink is discharged from a head of an upstream side of the transport direction of the heads for discharging color inks and a second printing mode in which the background ink is discharged from a head of a downstream side of the transport direction of the heads for discharging the color inks are present, and irradiation energy of the light irradiated by the pre-curing light source corresponding to the head for discharging the background ink in the second printing mode is less than irradiation energy of the light irradiated by the pre-curing light source corresponding to the head for discharging the background ink in the first printing mode.

The other features of the invention will be apparent from the present specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
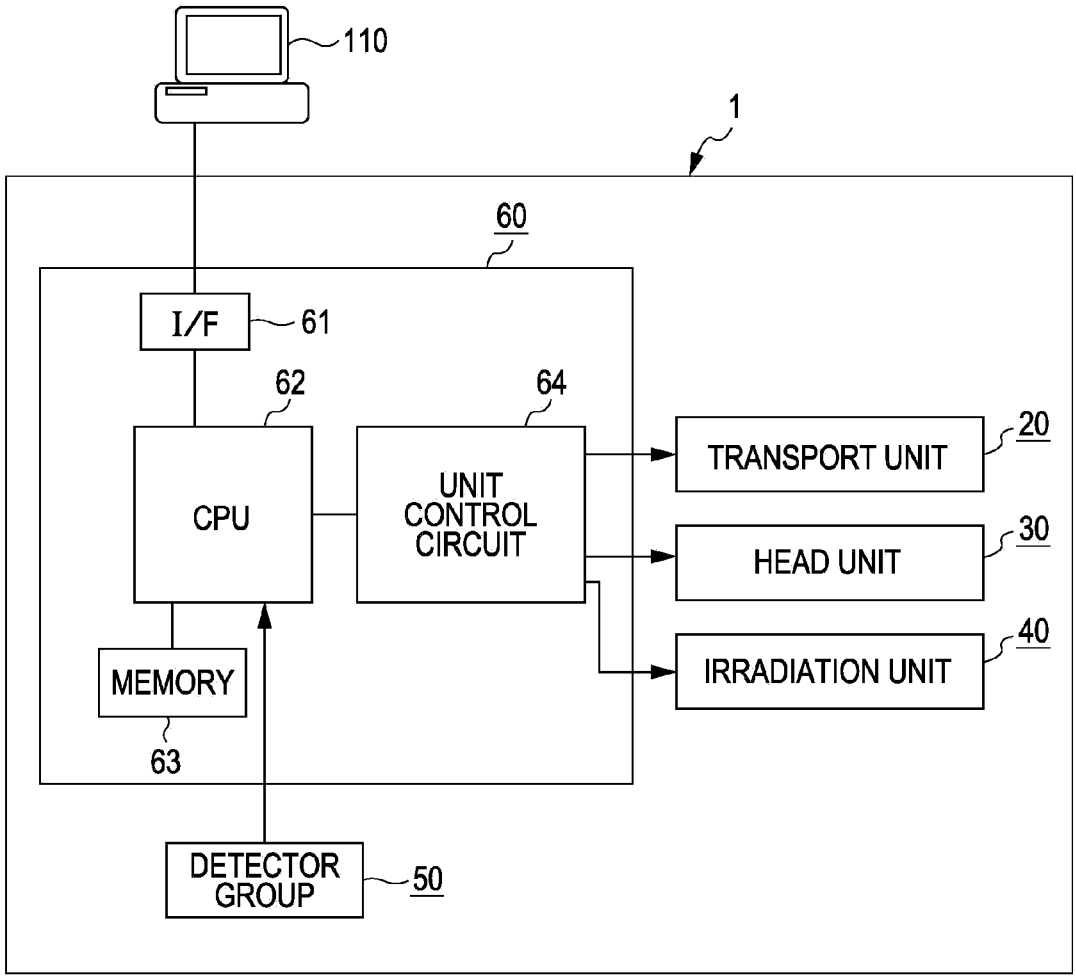
FIG. 1 is a block diagram of the overall configuration of a printer.

Herein, the following matters will be apparent from the present specification and the accompanying drawings.

There is provided a printing device including a plurality of heads configured to discharge inks cured by light irradiation and arranged in a transport direction of a medium; a plurality of pre-curing light sources provided in correspondence with the plurality of heads and configured to irradiate pre-curing light to dots formed on the medium by the heads; and a completely-curing light source configured to irradiate completely-curing light to the dots to which the light from the plurality of pre-curing light sources is irradiated, wherein a first printing mode in which a background ink is discharged from a head of an upstream side of the transport direction of the heads for discharging color inks and a second printing mode in which the background ink is discharged from a head of a downstream side of the transport direction of the heads for discharging the color inks are present, and irradiation energy of the light irradiated by the pre-curing light source corresponding to the head for discharging the background ink in the second printing mode is less than irradiation energy of the light irradiated by the pre-curing light source corresponding to the head for discharging the background ink in the first printing mode.

According to such a printing device, it is possible to improve image quality.

In the printing device, a plurality of detachably mounted cartridges may be included as a plurality of cartridges for receiving inks cured by light irradiation, and the first printing mode or the second printing mode may be selected according to replacement of each cartridge.

According to such a printing device, it is possible to automatically set a printing mode according to the replacement of the cartridge.

In the printing device, each of the plurality of cartridges may include a storage element for storing information about the type of the ink received therein.

According to such a printing device, it is possible to read the information about the ink received in the cartridge by mounting the cartridge.

In the printing device, the inks discharged by the plurality of heads may be predefined with respect to every head.

According to such a printing device, it is possible to simply and easily change the first printing mode and the second printing mode.

In the printing device, the head for discharging the background ink in the first printing mode may not discharge the background ink in the second printing mode, and the head for discharging the background ink in the second printing mode may not discharge the background ink in the first printing mode.

According to such a printing device, it is possible to execute the first printing mode and the second printing mode by changing the head for discharging the background ink.

In the printing device, the first printing mode may be a mode for printing an image viewed from a printed surface side and the second printing mode may be a mode for printing an image viewed from a medium side.

According to such a printing device, it is possible to suppress blurring between the color images and the background image in the first printing mode and to make the surface of the printed surface side smooth in the second printing mode.

In the following embodiments, for example, a line printer (printer 1) will be described as a printing device.

First Embodiment

Configuration of Printer

Figure 2:
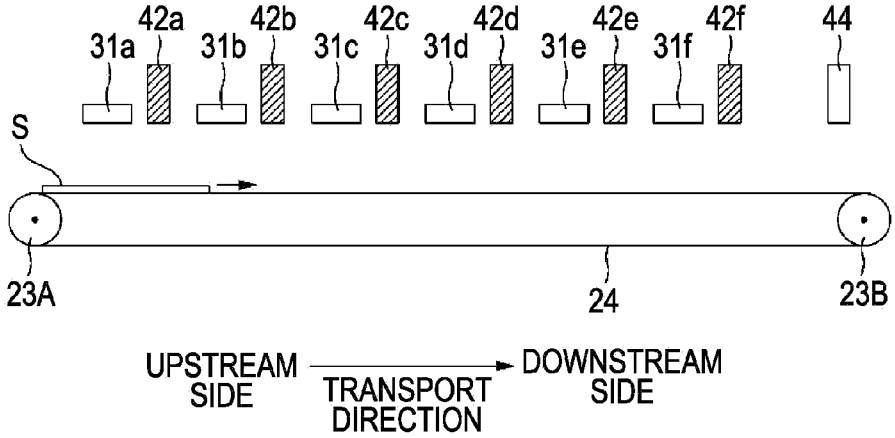
FIG. 2 is a schematic diagram of the periphery of a printing region.
Figure 3:
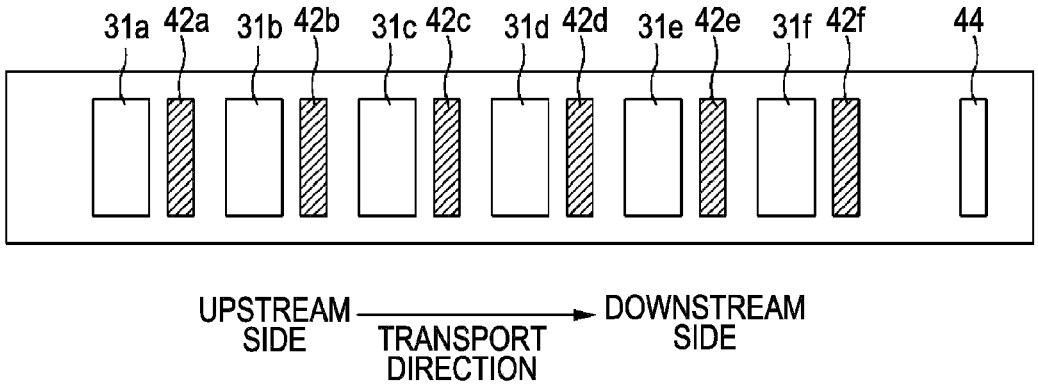
FIG. 3 is a diagram of FIG. 2 when viewed from the top.

FIG. 1 is a block diagram of the overall configuration of a printer 1. FIG. 2 is a schematic diagram of the periphery of a printing region. FIG. 3 is a diagram of FIG. 2 when viewed from the top.

The printer 1 is a printing device for printing an image on a medium such as paper, cloth, or a film and is communicatably connected to a computer 110, which is an external device.

In the computer 110, a printer driver is installed. The printer driver is a program for displaying a user interface on a display device (not shown) and converting image data output from an application program into printing data. This printer driver is recorded on a recording medium (computer-readable recording medium) such as a flexible disk FD or a CD-ROM. In addition, the printer driver may be downloaded to the computer 110 through the Internet. In addition, this program contains codes for realizing various functions.

The computer 110 outputs printing data corresponding to an image to be printed to the printer 1 such that the printer 1 prints the image.

The printer 1 of the present embodiment is a device for discharging an ultraviolet curable ink (hereinafter, referred to as a UV ink) cured by irradiation of an ultraviolet (hereinafter, referred to as UV) ray as an example of a liquid so as to print an image on a medium. The UV ink is an ink containing ultraviolet curable resin, and is cured by generation of a photopolymerization reaction with respect to the ultraviolet curable resin, when the UV ray is irradiated.

The printer 1 of the present embodiment includes a transport unit 20, a head unit 30, an irradiation unit 40, a detector group 50 and a controller 60. The printer 1 which receives printing data from the computer 110 which is the external device controls the units (the transport unit 20, the head unit 30 and the irradiation unit 40) by the controller 60, and prints the image on the medium according to the printing data. The controller 60 controls the units based on the printing data received from the computer 110 and prints the image on the medium. The internal status of the printer 1 is monitored by the detector group 50 and the detector group 50 outputs the detected result to the controller 60. The controller 60 controls the units based on the detected result output from the detector group 50.

The transport unit 20 transports the medium (for example, paper or the like) in a predetermined direction (hereinafter, referred to as a transport direction). This transport unit 20 includes an upstream transport roller 23A, a downstream transport roller 23B, and a belt 24. If a transport motor (not shown) is rotated, the upstream transport roller 23A and the downstream transport roller 23B are rotated and the belt 24 is rotated. The medium fed by a feeding roller (not shown) is transported to a printable region (a region facing a head) by the belt 24. By transporting the medium by the belt 24, the medium is moved to the head unit 30 in the transport direction. The medium passing through the printable region is ejected to the outside of the printer by the belt 24. In addition, the medium which is being transported is electrostatically suctioned or vacuum suctioned to the belt 24.

The head unit 30 discharges a UV ink to the medium. In addition, in the following embodiments, color inks (cyan, magenta, yellow, black and blue) for forming an image and a white ink for a background image are used as UV inks.

In the present embodiment, as shown in FIGS. 2 and 3, six heads (heads 31*a* to 31*f*) arranged in the transport direction are provided. Such heads discharge respective inks onto the medium, which is being transported, so as to form dots on the medium, thereby printing the image on the medium. In addition, as shown in FIG. 2, the head 31*a*, the head 31*b*, the head 31*c*, the head 31*d*, the head 31*e* and the head 31*f* are sequentially arranged from the upstream side of the transport direction such that the heads discharge the respective color inks as described below. The printer 1 of the present embodiment is the line printer, and the heads of the head unit 30 may form dots corresponding to the medium width all at once.

The irradiation unit 40 irradiates the UV ray to the UV inks landed on the medium. The dots formed on the medium are cured by the irradiation of the UV ray from the irradiation unit 40. The irradiation unit 40 of the present embodiment includes pre-curing irradiation units 42*a* to 42*f* and a completely-curing irradiation unit 44 so as to perform 2-step curing (UV irradiation) including pre-curing and completely-curing with respect to the dots formed on the medium.

The pre-curing irradiation units 42*a* to 42*f* irradiate the UV ray for temporarily curing the dots formed on the medium. In addition, in the present embodiment, pre-curing is performed in order to suppress blurring between UV inks and enlargement of dots.

The pre-curing irradiation unit 42*a* is provided on the downstream side of the transport direction of the head 31*a* and the pre-curing irradiation unit 42*b* is provided on the downstream side of the transport direction of the head 31*b*. In addition, the pre-curing irradiation unit 42*c* is provided on the downstream side of the transport direction of the head 31*c* and the pre-curing irradiation unit 42*d* is provided on the downstream side of the transport direction of the head 31*d*. In addition, the pre-curing irradiation unit 42*e* is provided on the downstream side of the transport direction of the head 31*e* and the pre-curing irradiation unit 42*f* is provided on the downstream side of the transport direction of the head 31*f*.

The length of the medium width direction of each of the pre-curing irradiation units is equal to or greater than the medium width. Each pre-curing irradiation unit irradiates the UV ray to the dots formed by the corresponding heads of the head unit 30.

In addition, each of the pre-curing irradiation units 42*a* to 42*f* of the present invention includes a Light Emitting Diode (LED) as a light source for irradiating the UV ray. The LED may easily change irradiation energy by controlling the level of input current. In addition, the wavelength of the LED is 375 to 420 nm in both pre-curing and completely-curing.

The completely-curing irradiation unit 44 irradiates the UV ray for completely curing the dots formed on the medium. In addition, in the present embodiment, the completely-curing is performed in order to completely cure the dots, and the irradiation amount of the UV ray of the completely-curing is greater than the irradiation amount of the UV ray of the pre-curing.

The completely-curing irradiation unit 44 is provided on the downstream side of the transport direction of the pre-curing irradiation unit 42*f*. In addition, the length of the medium width direction of the main-curing irradiation unit 44 is equal to or greater than the medium width. The completely-curing irradiation unit 44 irradiates the completely-curing UV ray to the dots formed by the heads and pre-cured by the pre-curing irradiation units.

The completely-curing irradiation unit 44 of the present embodiment includes a lamp (a metal halide lamp, a mercury lamp, or the like) as a light source for irradiating the UV ray. In addition, an LED may be used as the light source of the completely-curing irradiation unit 44.

In the detector group 50, a rotary encoder (not shown), a paper detection sensor (not shown), or the like is included. The rotary encoder detects the rotation amount of the upstream transport roller 23A or the downstream transport roller 23B. Based on the detected result of the rotary encoder, it is possible to detect the transport amount of the medium. The paper detection sensor detects the position of the tip of the medium which is being fed.

The controller 60 is a control unit (control portion) for performing the control of the printer. The controller 60 includes an interface unit 61, a CPU 62, a memory 63, and a unit control circuit 64. The interface unit 61 performs data transmission or reception between the computer 110 which is the external device and the printer 1. The CPU 62 is an arithmetic processing unit for performing the control of the overall printer. The memory 63 secures a region for storing the program of the CPU 62, a working region, or the like, and includes a storage element such as a RAM or an EEPROM. The CPU 62 controls the units through the unit control circuit 64 according to the program stored in the memory 63.

Process of Printer Driver

Figure 4:
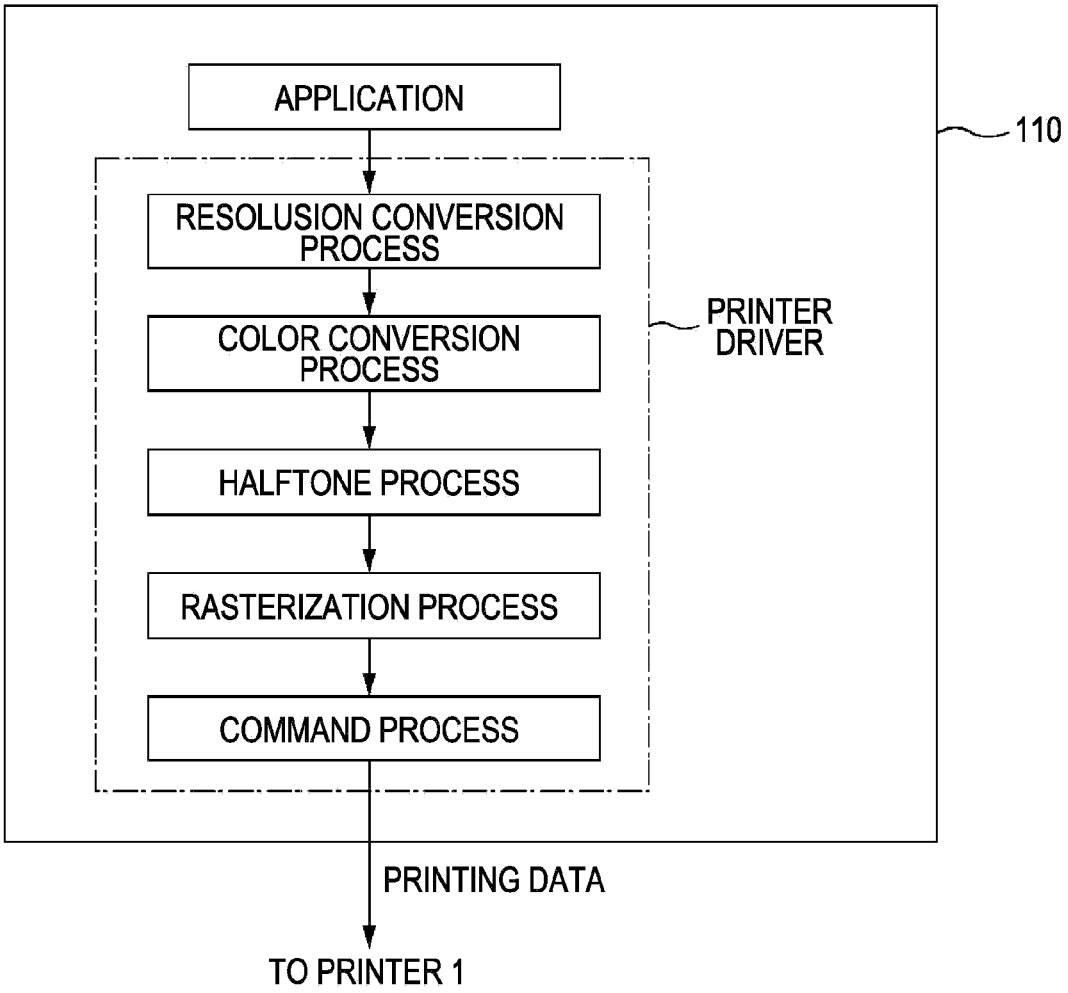
FIG. 4 is a flowchart of a process performed by a printer driver at the time of printing.

FIG. 4 is a flowchart of a process performed by a printer driver at the time of printing of the printer 1.

The printer driver receives image data from an application program, converts the image data into printing data with a format analyzable by the printer 1, and outputs the printing data to the printer. When the image data from the application program is converted into the printing data, the printer driver performs a resolution conversion process, a color conversion process, a halftone process, a rasterization process, a command adding process, and the like. Hereinafter, the various processes performed by the printer driver will be described.

The resolution conversion process is a process of converting the image data (text data, image data, or the like) output from the application program into resolution (print resolution) when printing onto paper is performed. For example, if the print resolution is set to 720×720 dpi, the image data with a vector format received from the application program is converted into image data with a bitmap format of resolution of 720×720 dpi. In addition, each pixel data of the image data after the resolution conversion process is multi-gradation (for example, 256-gradiation) RGB data expressed by an RGB color space.

The color conversion process is a process of converting the RGB data into data of a color space corresponding to an ink color forming the image. For example, if the image is printed using CMYK inks, the RGB data is converted into a CMYK color space. The color conversion process in this case is performed based on a table (color conversion Look-up Table (LUT)) in which the gradation values of the RGB data is associated with the gradation values of the CMYK data. In addition, in this case, the pixel data after the color conversion process is 256-gradation CMYK data expressed by the CMYK color space.

The halftone process is a process of converting data of a high gradation number into data of a gradation number formable by the printer. For example, by the halftone process, data indicating 256 gradations is converted into 1-bit data indicating 2 gradations or 2-bit data indicating 4 gradations. In the halftone process, a dither method, a γ correction/error diffusion method, or the like is used. The data subjected to the halftone process is a resolution equal to a printing resolution (for example, 720×720 dpi). In the image data after the halftone process, each pixel corresponds to 1-bit or 2-bit pixel data and this pixel data becomes data indicating the state (presence/absence of the dot or the size of the dot) of forming the dot in each pixel.

The rasterization process rearranges the pixel data arranged in a matrix in the order of the data to be transmitted to the printer 1 in each pixel data. For example, the pixel data is rearranged according to the arrangement order of the nozzles of each nozzle array.

The command adding process is a process of adding command data according to a printing method to the rasterized data. As the command data, for example, there is a transport data indicating a transport speed of the medium, or the like.

The printing data generated by such processes is transmitted to the printer 1 by the printer driver.

Printing Operation

When the printer 1 receives the printing data from the computer 110, the controller 60 first rotates the feeding roller (not shown) by the transport unit 20 and sends the medium to be printed onto the belt 24. The medium is transported on the belt 24 at a constant speed without stopping so as to pass under the head unit 30 and the irradiation unit 40. In this period, the controller 60 intermittently discharges the inks from the nozzles of the heads of the head unit 30 so as to form dots on the medium and irradiates the UV ray from the irradiation units of the irradiation unit 40. For example, the controller 60 discharges the inks from the head 31*a* when the medium passes under the head 31*a*. In addition, when the medium passing through the head 31*a* passes under the pre-curing irradiation unit 42*a*, the pre-curing UV ray is irradiated from the pre-curing irradiation unit 42*a*. Accordingly, the dots formed on the medium by the head 31*a* are pre-cured. Thereafter, the medium is similarly transported in the transport direction, the inks are discharged from the heads, and then the pre-curing UV ray is irradiated from the pre-curing irradiation units 42 corresponding to the heads. Finally, when the medium passes under the completely-curing irradiation unit 44, the completely-curing UV ray is irradiated from the completely-curing UV irradiation unit 44. Accordingly, the dots formed on the medium are completely cured. Thus, the image is printed on the medium. Then, the controller 60 ejects the medium on which the image is printed.

Inks

In the printer, "subtractive color mixture" is used in order to express various colors. The primary colors of the subtractive color mixture are three colors including cyan (C), magenta (M) and yellow (Y). Cyan (C) absorbs red (R) and reflects green (G) and blue (B). Magenta (M) absorbs green (G) and reflects red (R) and blue (B). Yellow (Y) absorbs blue (B) and reflects red (R) and green (G). That is, the cyan ink, the magenta ink and the yellow ink express the viewed image by adjusting the absorption amount of the three primary colors RGB of the light. Hereinafter, the cyan ink, the magenta ink and the yellow ink are referred to as a C ink, an M ink and a Y ink, respectively.

In addition, in the printer 1 of the present embodiment, a black ink (hereinafter, also referred to as a K ink) and a blue ink (hereinafter, also referred to as a B ink) are used in addition to the CMY ink as color inks. In addition, red, green, metallic, violet and the like may be used as the color inks.

The reason why the K ink is used is because dark black (deep black) may not be expressed by mixing the inks of the CMY three colors.

In addition, the reason why the B ink is used is because of the following.

For example, in a landscape photograph, it is important to express the bright blue of the sky. In this case, if the blue ink (hereinafter, also referred to as a B ink) is used, it is possible to express bright blue.

In addition, in the following description, dots formed by such color inks are referred to as color dots.

In addition, in the present embodiment, a white ink (hereinafter, also referred to as a W ink) is used. In addition, in the following description, a dot generated by the W ink is also referred to as a background dot.

The W ink is a white ink for printing the background color (white color) of the color image, for example, when printing is performed with respect to a transparent medium. By setting the background to the white color, it is easy to view the color image.

Such inks are contained in a cartridge (which will be described later) which is detachably mounted in a main body of the printer 1, and such a cartridge is mounted in each head such that the ink corresponding to each head is discharged. That is, by changing (replacing) the mounted cartridge, it is possible to change the ink discharged from each head.

Nozzle Arrangement of Each Head

Figure 5:
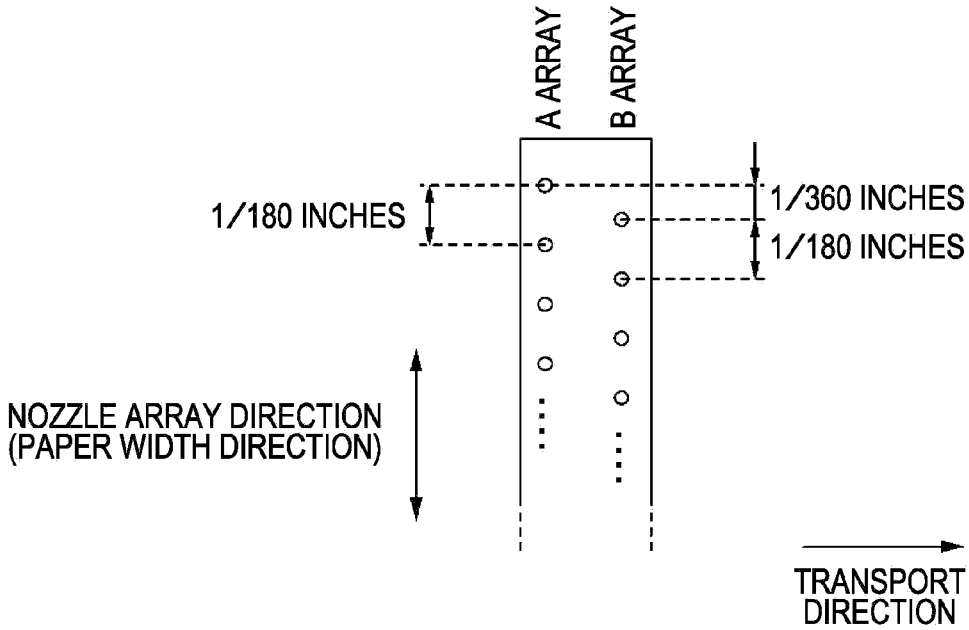
FIG. 5 is an explanatory diagram of the nozzle arrangement of each head.

FIG. 5 is an explanatory diagram of the nozzle arrangement of each head. Each head has two nozzle arrays including "A array" and "B array" as shown in the drawing.

The nozzles of each array are arranged at an interval (nozzle pitch) of 1/180 inches along a direction (nozzle array direction) crossing the transport direction. The position of the nozzle array direction of the nozzles of the A array and the position of the nozzle array direction of the nozzles of the B array are deviated by half a nozzle pitch (1/360 inches). Accordingly, it is possible to form dots of each color with a resolution of 1/360 inches.

Configuration of Head

Next, the configuration of the head will be described.

Figure 6:
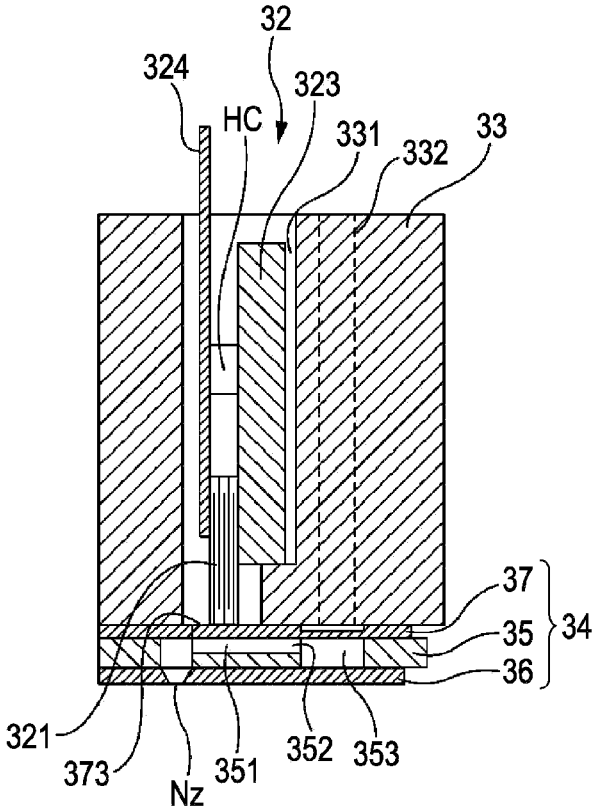
FIG. 6 is a cross-sectional view of a head.

FIG. 6 is a cross-sectional view of the head. In addition, FIG. 6 shows the cross-section of a portion corresponding to one nozzle shown in FIG. 4. As shown in the drawing, the head includes a driving unit 32, a case 33 for containing the driving unit 32, and a fluid channel unit 34 mounted in the case.

The driving unit 32 includes a piezoelectric element group including a plurality of piezoelectric elements 321, a fixing plate 323 to which the piezoelectric element group is fixed, and a flexible cable 324 for supplying power to the piezoelectric elements 321. The piezoelectric elements 321 are mounted on the fixing plate 323 in a so-called cantilever state. The fixing plate 323 is a rigid plate-shaped member, which receives reactive force from the piezoelectric elements 321. The flexible cable 324 is a flexible sheet-shaped wiring substrate and is electrically connected to the piezoelectric elements 321 on a side surface of a fixing end which is an opposite side of the fixing plate 323. On the surface of the flexible cable 324, a head control unit HC which is a control IC for controlling the driving or the like of the piezoelectric elements 321 is mounted.

The case 33 has a parallelepiped block shape and has a containing space portion 331 for containing the driving unit 32. The fluid channel unit 34 is adhered to a front end surface of the case 33. The containing space portion 331 is of a size enabling the driving unit 32 to be fitted thereinto. In addition, in the case 33, an ink supply pipe 332 for supplying the ink from the corresponding cartridge (which will be described later) to the fluid channel unit 34 is formed.

The fluid channel unit 34 includes a fluid channel forming substrate 35, a nozzle plate 36, and an elastic plate 37, and is integrally formed by laminating the fluid channel forming substrate, the nozzle plate and the elastic plate such that the fluid channel forming substrate 35 is inserted between the nozzle plate 36 and the elastic plate 37. The nozzle plate 36 is a thin plate made of stainless steel, in which nozzles Nz are formed.

In the fluid channel forming substrate 35, a plurality of space portions each including a pressure chamber 351 and an ink supply port 352 is formed in correspondence with the nozzles Nz. A reservoir 353 is a liquid containing chamber for supplying the ink contained in the cartridge to each pressure chamber 351 and communicates with the other end of the pressure chamber 351 corresponding thereto through the ink supply port 352. In addition, the ink supplied from the cartridge is introduced into the reservoir 353 through the ink supply port 332.

The driving unit 32 is inserted into the containing space portion 331 in a state in which free ends of the piezoelectric elements 321 face the fluid channel unit 34 side and is adhered to an island portion 373 corresponding to the front end surfaces of the free ends. In addition, a rear surface of the fixing plate 323 is adhered to an inner wall surface of the case 33 partitioning the containing space portion 331. When a driving signal is supplied to the piezoelectric elements 321 through the flexible cable 324 in this containing state, the piezoelectric elements 321 expand and contract so as to expand and contract the volume of the pressure chamber 351. By the volume variation of the pressure chamber 351, a pressure variation occurs in the ink contained in the pressure chamber 351. Then, it is possible to inject ink droplets from the corresponding nozzles Nz by using the ink pressure variation.

Configuration of Cartridge and Cartridge Mount Unit

Figure 7:
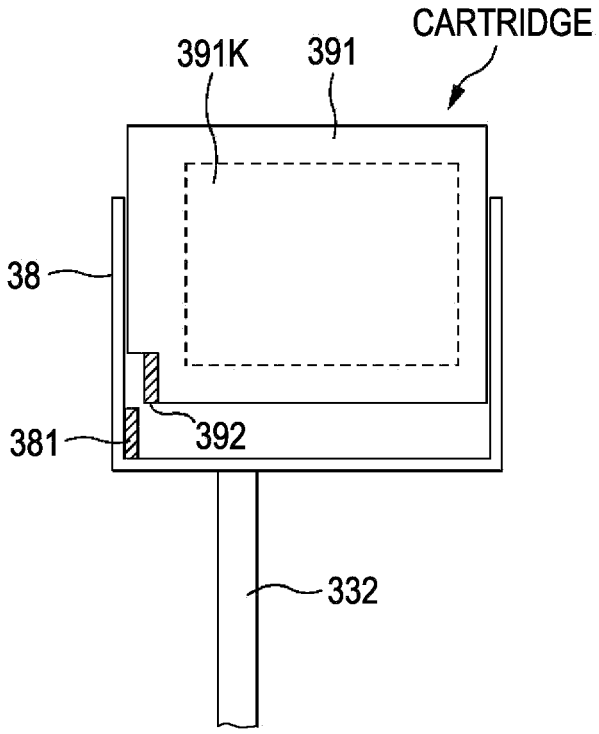
FIG. 7 is a schematic diagram of the structure of a cartridge and a cartridge mount unit.

FIG. 7 is a schematic diagram of an example of the structure of a cartridge and a cartridge mount unit 38. In addition, the cartridge mount unit 38 is provided in correspondence with each head. That is, the cartridge is mounted in each head. The configuration of the cartridge and the cartridge mount unit 38 of each head is the same and one cartridge and one cartridge mount unit will be described. In addition, for a cartridge mounting method, a method (on cartridge method) of mounting the cartridge in the head or a method (off cartridge method) of mounting the cartridge (in the main body of the printer) so as to be spaced from the head and supplying the ink from the cartridge to the head through a tube may be used.

In FIG. 7, the cartridge includes a cartridge main body 391 configuring an ink reception unit 391K for receiving a UV ink therein and a storage element 392 provided on a side frame portion of the cartridge main body 391. This storage element 392 is an element for transmitting and receiving a variety of data to or from the printer 1 (the controller 60) when the cartridge is mounted in the cartridge mount unit 38 of the main body of the printer 1 and includes an element for storing a variety of data, such as a non-volatile memory such as a flash memory. In addition, on the surface of the storage element 392, a plurality of connection terminals (not shown) is exposed.

The cartridge mount unit 38 includes a connector 381 disposed on an inner wall of the cartridge mount unit 38. In this connector 381, a plurality of connection terminals (not shown) electrically connected to the plurality of connection terminals of the storage element 392 when the cartridge is mounted in the cartridge mount unit 38 is formed.

When the cartridge is mounted in the cartridge mount unit 38, the supply of the ink from the ink reception unit 391K of the cartridge to the head through the ink supply pipe 332 is possible. When the cartridge is mounted in the cartridge mount unit 38, the plurality of connection terminals of the storage element 392 of the cartridge and the plurality of connection terminals of the connector 381 of the cartridge mount unit 38 are electrically connected, respectively, and data transmission or reception is possible between the printer 1 (the controller 60) and the storage element 392.

In addition, in the storage element 392, for example, information indicating characteristics of the color, concentration, viscosity and the like of the ink received in the cartridge, various print control programs, and the like are stored. Information about a time when the ink (cartridge) was generated, information about a time when the cartridge was mounted, and the like may be stored in the storage element 392.

In the present embodiment, the printer 1 (the controller 60) may read information about the cartridge from the storage element 392 by mounting the cartridge in the cartridge mount unit 38 of the printer 1.

Pre-Curing and Completely-Curing

In the present embodiment, the dots are cured by irradiating the UV ray to the UV ink landed on the medium. In the printer 1 of the present embodiment, the pre-curing irradiation units 42*a* to 42*f* for performing UV irradiation for pre-curing of the UV ink and the completely-curing irradiation unit 44 for performing UV irradiation for completely-curing are included as the irradiation unit 40 so as to perform 2-step curing. In addition, the pre-curing is to suppress blurring between UV inks landed on the medium or enlargement of dots and the completely-curing is to completely cure the UV ink. Accordingly, the irradiation energy of the UV ray of the completely-curing is greater than the irradiation energy of the UV ray of the pre-curing. In addition, the irradiation energy ($mJ/cm^2$) of the UV ray is the UV irradiation intensity ($mW/cm^2$)×time (sec). In detail, while the UV irradiation energy of the pre-curing is 3 to 30 $mJ/cm^2$ (preferably, 5 to 15 $mJ/cm^2$), the UV irradiation energy of the completely-curing is 200 to 500 $mJ/cm^2$.

The pre-curing is to control blurring between UV inks landed on the medium or enlargement of dots, and the shape of the dot is substantially decided by pre-curing.

Figure 8A:
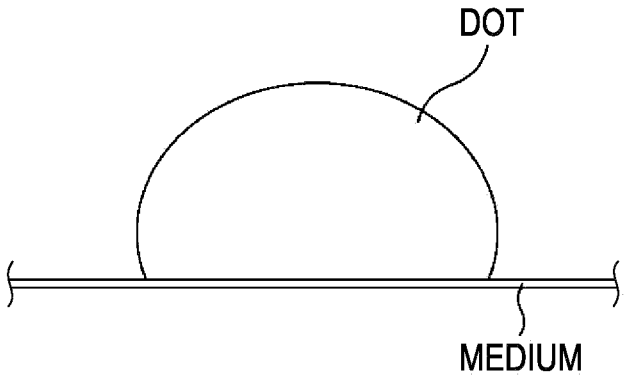
FIGS. 8A to 8C are explanatory diagrams of a relationship between the shape of a UV ink landed on a medium and UV irradiation energy of pre-curing.
Figure 8B:
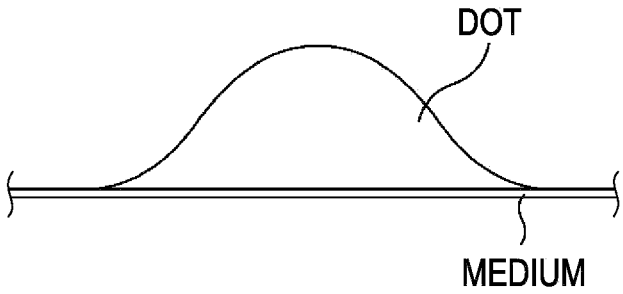
Figure 8C:
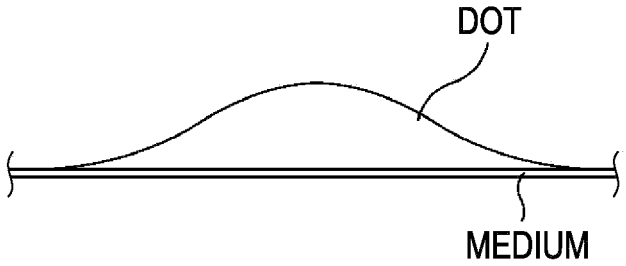

FIGS. 8A to 8C are explanatory diagrams of a relationship between the shape of a UV ink (dot) landed on a medium and UV irradiation energy of pre-curing. In addition, the UV irradiation energy is decreased in order of FIGS. 8A, 8B and 8C.

If the UV irradiation energy of the pre-curing is large, for example, the ink has a shape shown in FIG. 8A. In this case, blurring between inks or enlargement of dots is suppressed, but unevenness of the surface of the medium configured by the dot is increased and thus gloss deteriorates.

In contrast, if the UV irradiation energy of the pre-curing is small, for example, the ink has a shape shown in FIG. 8C. In this case, good gloss is obtained. However, blurring with another ink is prone to be generated and enlargement of the dot is increased.

Printing Process of First Embodiment

In the present embodiment, as described above, it is possible to change the ink supplied to each head according to the cartridge mounted in the cartridge mount unit 38 of the printer 1.

Figures 9, 10:
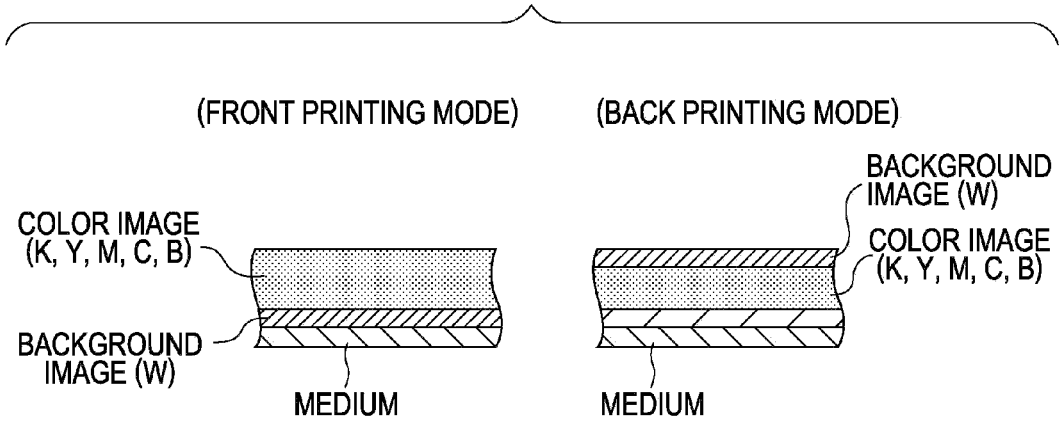
FIG. 9 is a diagram showing a relationship between a printing mode according to a first embodiment and an ink.
FIG. 10 is an explanatory diagram of an image formed by the printing mode of the first embodiment.

FIG. 9 is a diagram showing a relationship between a printing mode according to a first embodiment and an ink. FIG. 10 is an explanatory diagram of an image formed by the printing mode of the first embodiment.

In the present embodiment, two printing modes including a mode (hereinafter, referred to as a front printing mode) for printing a printed material in which an image is viewed from a printed surface and a mode (hereinafter, referred to as a back printing mode) for printing a printed material in which an image is viewed from a medium side using a transparent medium are performed. In addition, the front printing mode corresponds to a first printing mode and the back printing mode corresponds to a second printing mode.

As shown in FIG. 9, in the present embodiment, in order to form an image, color inks (a K ink, Y ink, an M ink, a C ink and a B ink) of five colors and a background W ink are used. For example, in the front printing mode, the cartridge of the W ink is mounted in the cartridge mount unit 38 corresponding to the head 31*a*. Thus, the W ink is discharged from the head 31*a*. In addition, for example, the cartridge of the B ink is mounted in the cartridge mount unit 38 corresponding to the head 31*f*. Thus, the B ink is discharged from the head 31*f*.

In the front printing mode, first, the W ink is discharged from the head 31*a* of the uppermost stream side of the transport direction. Thus, the white background image is printed on the medium. Thereafter, the color inks (the K ink, the Y ink, the M ink, the C ink and the B ink) of five colors are discharged from the head 31*b* to the head 31*f* on the background image so as to print a color image. In addition, although not described herein, after the inks are discharged from the heads, the UV ray for pre-curing is irradiated from the pre-curing irradiation unit corresponding thereto so as to perform pre-curing just after dots are formed. The same is true in the following description.

In the back printing mode, the cartridge of the K ink is mounted in the cartridge mount unit 38 corresponding to the head 31*a*. Thus, the K ink is discharged from the head 31*a*. In addition, for example, the cartridge of the W ink is mounted in the cartridge mount unit 38 corresponding to the head 31*f*. Thus, the W ink is discharged from the head 31*f*.

In the back printing mode, for example, a color image is printed on a transparent medium using color inks (the K ink, the Y ink, the M ink, the C ink and the B ink) of five colors. The W ink is discharged from the head 31*f* of the lowermost stream side of the transport direction on the color image so as to form a background image. Thus, an image viewed from the medium side is printed.

The controller 60 reads information from the storage element 392 of each cartridge and may detect the type (color) of the cartridge mounted with respect to each head so as to select a printing mode corresponding thereto. The controller 60 transmits the read information to the printer driver of the computer 110. The printer driver prepares printing data according to each printing mode and transmits the printing data to the printer 1. In the present embodiment, it is possible to automatically change the printing mode by exchanging the cartridge.

In the back printing mode, since the head 31*f* for discharging the W ink is located at the downstream side of the transport direction of the other heads 31*a* to 31*e*, the W ink is discharged later than the other color inks. In the back printing mode, since the color inks (color dots) are already pre-cured when the W ink is discharged, the possibility of causing blurring between the W ink and the color inks is low. Nevertheless, when the W ink is pre-cured under the same condition as the other color inks, the surface is uneven and thus image quality may deteriorate (see FIGS. 8A to 8C). Therefore, in the present embodiment, in the back printing mode (in the case where the background dots are formed later than the other color dots), the UV irradiation energy of the pre-curing irradiated to the background dots is reduced.

Figure 11:
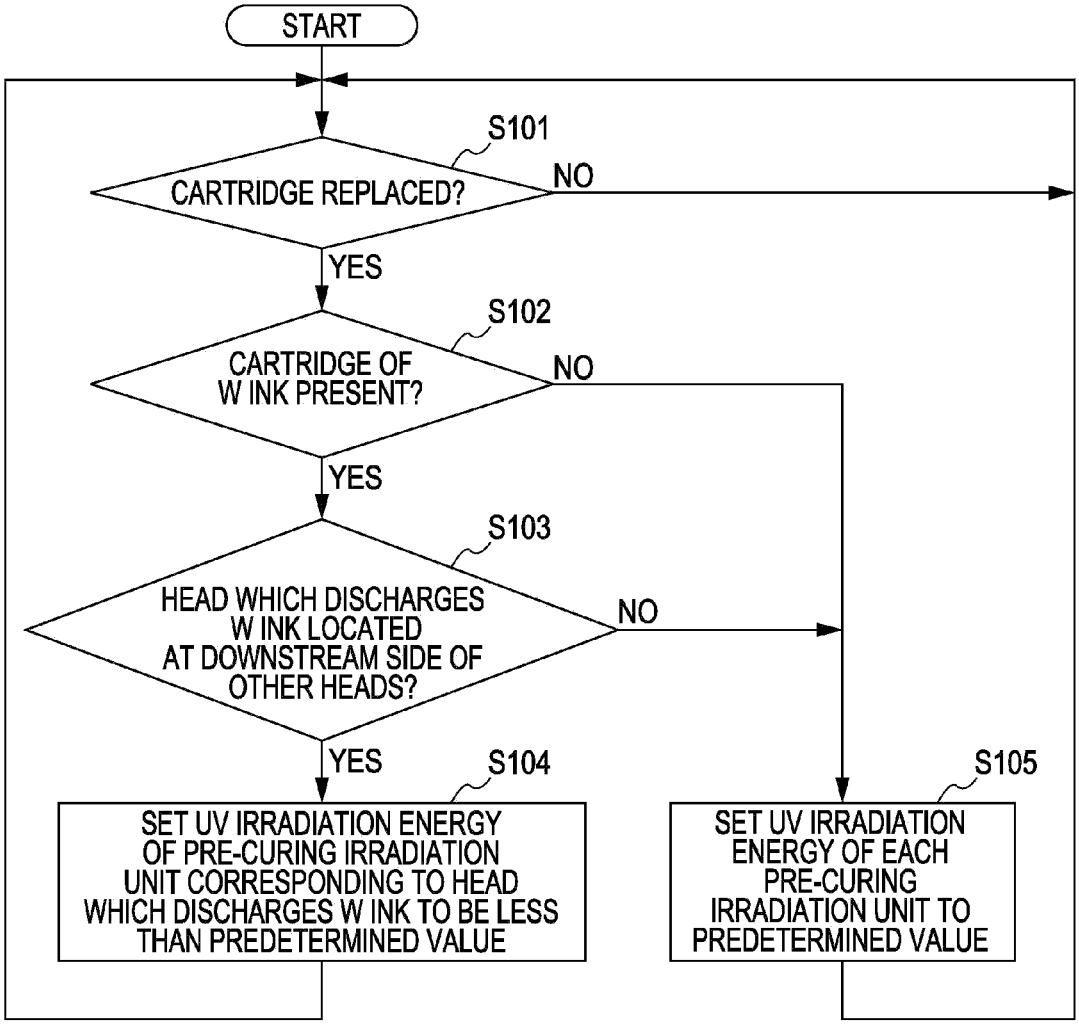
FIG. 11 is a flowchart of a process when an ink is replaced, in the first embodiment.

FIG. 11 is a flowchart of a process when an ink is replaced, in the first embodiment.

First, the controller 60 determines whether or not the cartridge corresponding to each head is replaced (S101). If it is determined that the cartridge is replaced (YES, in S101), the controller 60 determines whether or not the cartridge for the W ink is present in the mounted cartridge (S102).

If it is determined that the cartridge for the W ink is present (YES in S102), it is determined whether or not the head in which the cartridge for the W ink is mounted is located at the downstream side of the transport direction of the other heads for discharging the color inks (S103). If it is determined that the head in which the cartridge for the W ink is mounted is located at the downstream side of the transport direction of the other heads for discharging the color inks (YES, in S103), the controller 60 sets the UV irradiation energy of the pre-curing irradiation unit corresponding to the head for discharging the W ink to be less than a predetermined value for pre-curing (S104). That is, the UV irradiation energy of the pre-curing irradiation unit corresponding to the head for discharging the W ink is set to be less than the UV irradiation energy of the other pre-curing irradiation units. Then, the process returns to step S101.

If it is determined that the cartridge for the W ink is not present in step S102 (NO in S102) and if it is determined that the head in which the cartridge for the W ink is mounted is located at the downstream side of the transport direction of the other heads for discharging the color inks in step S103 (NO in S103), the irradiation energy of each pre-curing irradiation unit is set to the predetermined value (S105) and the process returns to step S101.

For example, in FIG. 9, in the front printing mode, since the head (head 31*a*) for discharging the W ink is located at the upstream side of the transport direction of the other heads for discharging the color inks, the determination of S103 is NO. Accordingly, the irradiation energy of each pre-curing irradiation unit is set to the predetermined value. If the front printing mode is changed to the back printing mode, the cartridge of the W ink of the head 31*a* is replaced with the cartridge of the K ink and the cartridge of the B ink of the head 31*f* is replaced with the cartridge of the W ink. The controller 60 determines whether the head (head 31*f*) in which the cartridge of the W ink is located at the downstream side of the transport direction of the other heads for discharging the color inks, when it is detected that the cartridge of the W ink is mounted. In the back printing mode, since the head (head 31*f*) for discharging the W ink is located at the downstream side of the transport direction of the other heads for discharging the color inks, the determination of S103 is YES. Accordingly, the controller 60 decreases the input current to the light source (LED) of the pre-curing irradiation unit 42*f* corresponding to the head 31*f* so as to lower the UV irradiation energy from the pre-curing irradiation unit 42*f*. In this case, since the UV irradiation energy of the pre-curing irradiated to the W ink (background dots) is decreased, but the color inks precedently discharged onto the medium are already pre-cured, the possibility of causing blurring between the color dots and the background dots is low. In addition, the UV irradiation energy of the pre-curing of the background dots is decreased so as to make the surface of the background image formed by the background dots smooth.

Therefore, it is possible to suppress blurring between the color inks and the W ink in the front printing mode and to make the surface of the background image formed by the W ink smooth in the back printing mode with low possibility of causing blurring. Accordingly, it is possible to effectively use the W ink in the front printing and the back printing and to improve image quality in each case.

In addition, although, in the present embodiment, the irradiation energies for the pre-curing of the inks of the respective colors have the same value (predetermined value), the value of the irradiation energy suitable for the pre-curing may be set with respect to each ink color. For example, since it is difficult to cure the K ink as compared with the inks of the other colors, the UV irradiation energy of the pre-curing of the pre-curing irradiation unit corresponding to the head for discharging the K ink may be set to be large.

In the present embodiment, although, in step S104 of FIG. 11, the UV irradiation energy of the pre-curing irradiation unit corresponding to the head for discharging the W ink is lowered, UV ray may not be irradiated. In this case, it is possible to make the surface of the background image smoother.

Second Embodiment

Although, in the first embodiment, the ink discharged by each head is changed by replacing the cartridge, the ink discharged by each head is fixed in the second embodiment. That is, a cartridge of a predetermined color is mounted in each head. Although, in the first embodiment, the controller 60 automatically sets the printing mode by the cartridge mounted in each head, for example, the printing mode is set according to the input of the user to the user interface displayed on the display device (not shown) of the computer 110 in the second embodiment.

Figures 12, 13:
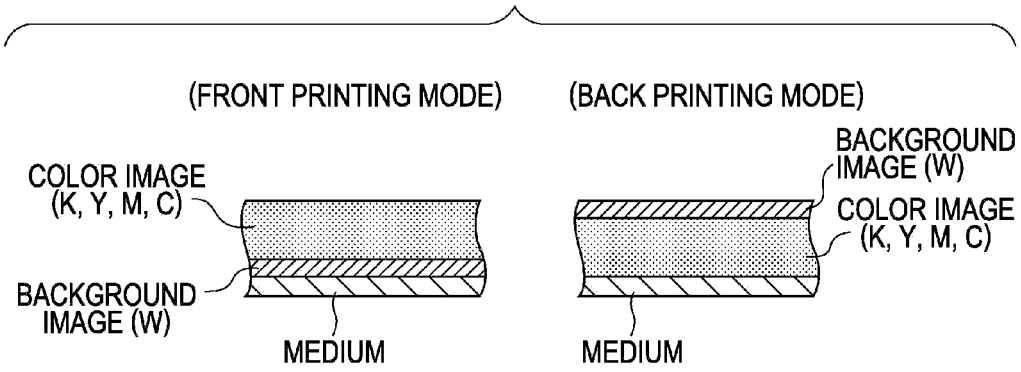
FIG. 12 is a diagram showing a relationship between a printing mode according to a second embodiment and an ink.
FIG. 13 is an explanatory diagram of an image formed by the printing mode of the second embodiment.

FIG. 12 is a diagram showing a relationship between a printing mode according to a second embodiment and an ink. FIG. 13 is an explanatory diagram of an image formed by the printing mode of the second embodiment. In addition, in FIG. 12, the head used in each printing mode is ○ and the head which is not used is denoted by x.

As shown in FIG. 12, in each head, the cartridge of the color ink corresponding thereto is mounted. For example, the cartridge of the W ink is mounted in the head 31*a* and the W ink is discharged from the head 31*a*. In addition, the W ink is dischargeable from the head 31*a* of the most upstream side of the transport direction and the head 31*f* of the most downstream side of the transport direction among the heads of the printer 1.

In the front printing mode of the second embodiment, the controller 60 discharges the ink from the heads 31*a* to 31*e* and does not discharge the ink (W ink) from the head 31*f*.

In the front printing mode, first, the W ink is discharged from the head 31*a* of the most upstream side of the transport direction. Accordingly, as shown in FIG. 13, the background image (background dots) is formed on the medium. Thereafter, the color inks (the K ink, the Y ink, the M ink and the C ink) of four colors are discharged from the heads 31*b* to 31*e* onto the background image so as to print the color image.

In addition, in the front printing mode, the UV irradiation of the pre-curing is performed from the pre-curing irradiation units 42*a* to 42*e* corresponding to the heads 31*a* to 31*e* and the UV irradiation of the pre-curing is not performed from the pre-curing irradiation unit 42*f* corresponding to the head 31*f* which does not discharge the ink.

In the back printing mode of the second embodiment, the controller 60 discharges the ink from the heads 31*b* to 31*f* and does not discharge the ink (W ink) from the head 31*a*.

In the back printing mode, first, the color inks (the K ink, the Y ink, the M ink and the C ink) of four colors are discharged from the heads 31*b* to 31*e* onto the medium so as to print the color image. Then, the W ink is discharged from the head 31*f* of the most downstream side of the transport direction on the color image. Accordingly, as shown in FIG. 13, the background image (background dots) is formed on the color image.

In addition, the back printing mode, the UV irradiation of the pre-curing is performed from the pre-curing irradiation units 42*b* to 42*f* corresponding to the heads 31*b* to 31*f* and the UV irradiation of the pre-curing is not performed from the pre-curing irradiation unit 42*a* corresponding to the head 31*a*.

Figure 14:
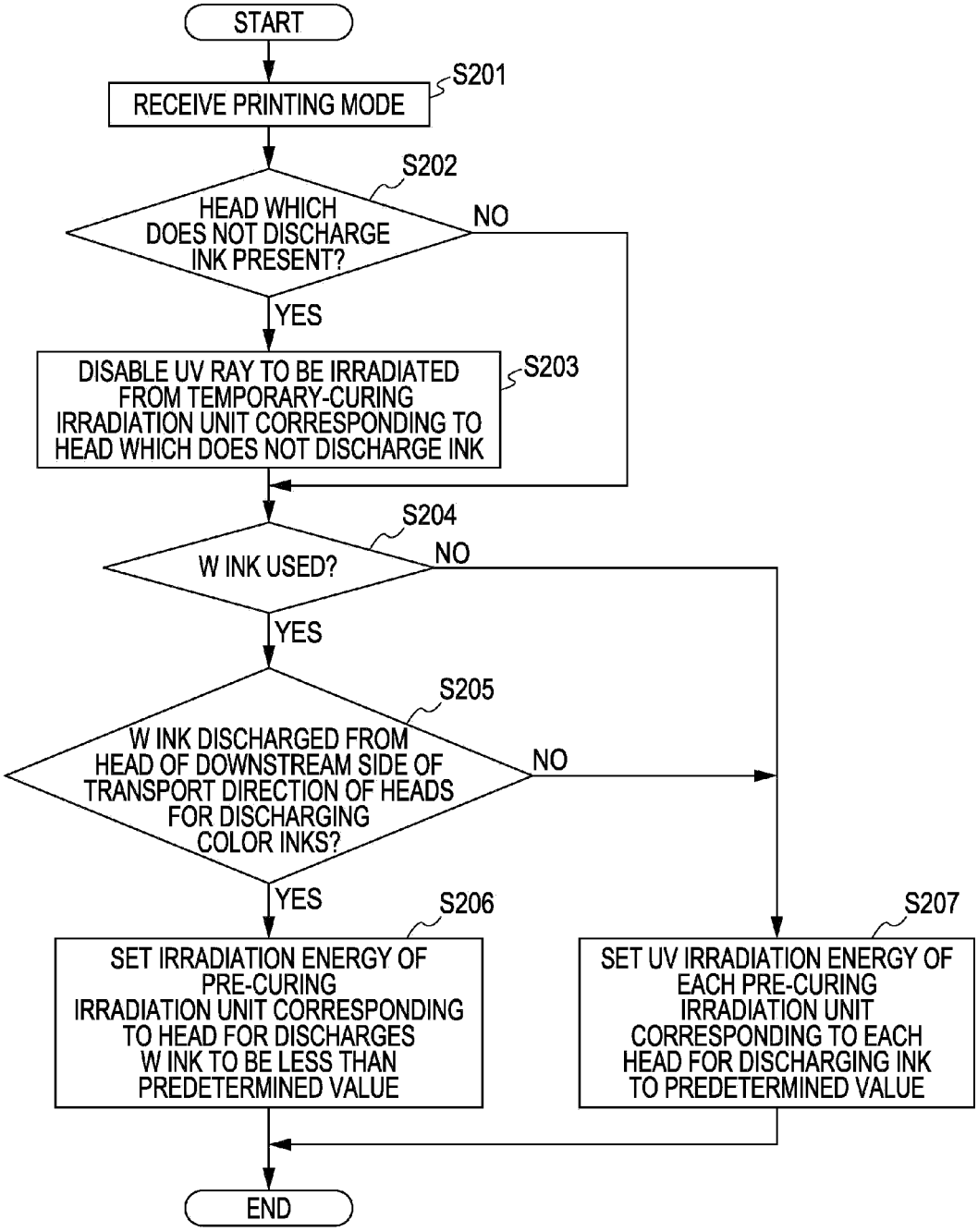
FIG. 14 is a flowchart of a process at the time of printing of the second embodiment.

FIG. 14 is a flowchart of a process at the time of printing of the second embodiment.

First, the printing mode is received from the printer driver (S201) and the controller 60 determines whether or not the head which does not discharge the ink is present in the printing mode (S202). If it is determined that the head which does not discharge the ink is present (YES in S202), the controller 60 disables the UV ray to be irradiated from the pre-curing irradiation unit corresponding to the head which does not discharge the ink (S203). In the present embodiment, the head which does not discharge the ink is present in the front printing mode and the back printing mode. For example, in the front printing mode, the controller 60 disables the UV ray to be irradiated from the pre-curing irradiation unit 42*f* corresponding to the head 31*f* which does not discharge the ink.

If the determination of step S202 is NO, the controller 60 determines whether or not the W ink is used, after step S203 (S204).

If it is determined that the W ink is used (YES, in S204), it is determined whether or not the W ink is discharged from the head of the downstream side of the transport direction of the heads for discharging the color inks (S205). If it is determined that the W ink is discharged from the head of the downstream side of the transport direction of the heads for discharging the color inks (YES, in S205), the controller 60 sets the UV irradiation energy of the pre-curing irradiation unit corresponding to the head for discharging the W ink to be less than a predetermined value for pre-curing (S206). That is, the UV irradiation energy of the pre-curing irradiation unit corresponding to the head for discharging the W ink is set to be less than the UV irradiation energy of the other pre-curing irradiation units.

If it is determined that the W ink is not used in step S204 (NO, in S204) and if it is determined that the W ink is not discharged from the head of the downstream side of the transport direction of the heads for discharging the color inks in step S205 (NO. in S205), the irradiation energy of each pre-curing irradiation unit corresponding to the head for discharging the ink is set to the predetermined value (S207).

For example, in the front printing mode of FIG. 12, since the W ink is discharged from the head (head 31*a*) of the upstream side of the transport direction of the heads for discharging the color inks, the determination of step S205 of FIG. 14 is NO and all the UV irradiation energies of the pre-curing irradiation units corresponding to the heads for discharging the inks is set to the same value (predetermined value) (S207). In contrast, in the back printing mode, since the W ink is discharged from the head (head 31*f*) of the downstream side of the transport direction of the heads for discharging the color inks, the determination of step S205 of FIG. 14 is YES and the irradiation energy of the pre-curing irradiation unit 31 corresponding to the head 31*f* is set to be less than the predetermined value (S206). That is, the UV irradiation energy of the pre-curing irradiated to the background image (W ink) in the back printing mode is less than the UV irradiation energy of the pre-curing irradiated to the background image (W ink) in the front printing mode. Thus, similarly to the first embodiment, it is possible to suppress blurring between the color inks and the W ink in the front printing mode and to make the surface of the background image formed by the W ink smooth in the back printing mode with low possibility of causing blurring.

In addition, in the second embodiment, similarly to the first embodiment, it is not necessary to change the cartridge when the printing mode is changed and it is possible to change the front printing mode and the back printing mode by only changing the head for discharging the W ink. Accordingly, it is possible to simply and easily change the printing mode.

Other Embodiments

Although the printer or the like is described as one embodiment, the above embodiments are intended to facilitate the understanding of the invention and are not analyzed to limit the invention. The invention may be modified or changed without departing from the scope thereof and the invention includes equivalents thereof. In particular, the following embodiments are included in the invention.

Printer

Although, in the above-described embodiments, the printer is described as an example of the printing device, the invention is not limited thereto. For example, the technology of the present embodiment may be applied to various printing devices using ink jet technology, such as a color filter manufacturing device, a dyeing device, a microfabrication device, a semiconductor manufacturing device, a surface treatment device, a three-dimensional shaping machine, a liquid vaporization device, an organic EL manufacturing device (in particular, a high-molecular EL manufacturing device), a display manufacturing device, a film forming device, or a DNA chip manufacturing device.

Although the line printer is used in the above-described embodiments, the invention is not limited thereto. For example, a printer in which a plurality of heads and a plurality of pre-curing irradiation units are alternately provided so as to face a circumferential surface of a cylindrical transport drum and a completely-curing irradiation unit is provided at a most downstream side of a transport direction may be used. Even in this case, similarly to the above-described embodiments, it is possible to set the irradiation condition of the pre-curing irradiation unit.

Ink

In the above-described embodiments, the ink (UV ink) cured by the UV irradiation is discharged from nozzles. However, the liquid discharged from the nozzles is not limited to the ink cured by the UV ray and may be an ink cured by visible light. In this case, each irradiation unit irradiates the visible light (light) with a wavelength for curing the ink.

Although cyan, magenta, yellow, black and blue inks are used as the color inks in the present embodiment, inks of other colors (for example, red, green, orange and the like) may be used. In addition to the color inks, a colorless transparent clear ink may be used.

Although the white ink (W ink) is used as the background ink in the present embodiment, the invention is not limited thereto. For example, a background having a color different from that of the medium may be printed using an ink having a color different from that of the medium.

Number of Heads

Although the number of heads (and the pre-curing irradiation units) is 6 in the above-described embodiments, the invention is not limited thereto. For example, the number of heads (and the corresponding pre-curing irradiation units) may be 5 or may be 7 or more. Although one head is used with respect to one color ink in the above-described embodiments, the invention is not limited thereto and a plurality of heads may be used with respect to one color ink.

Printer Driver

The process of the printer driver of FIG. 4 may be performed by the printer. In this case, a printing device is configured in a printer and a PC in which a printer driver is installed.

White

In addition, white is not limited to pure white such as (1) a color within a color range in which an expression of an Lab system is located at a circle with a radius 20 and on the inside thereof on an a*b* plane when a color is measured using the color measuring machine Eye-One Pro manufactured by X-Rite Incorporated under the condition of a color measuring mode: spot color measuring, light source: D50, backing: black, printing medium: transparent film and L* is expressed by 70 or more, (2) a color within a color range in which an expression of an Lab system is located at a circle with a radius 20 and on the inside thereof on an a*b* plane when a color is measured using a color meter CM2022 manufactured by Minolta under the condition of a measuring mode: D502° viewing field, SCF mode and white background and L* is expressed by 70 or more, or (3) a color of an ink used as the background of an image described in JP-A-2004-306591.

The entire disclosure of Japanese Patent Application No. 2009-248111, filed Oct. 28, 2009 is expressly incorporated by reference herein.

What is claimed is:

1. A printing device comprising:

a plurality of heads configured to discharge inks cured by light irradiation and arranged in a transport direction of a medium;

a plurality of pre-curing light sources provided in correspondence with the plurality of heads and configured to irradiate pre-curing light to dots formed on the medium by the heads; and a completely-curing light source configured to irradiate completely-curing light to the dots to which the light from the plurality of pre-curing light sources is irradiated, wherein a first printing mode includes discharging a background ink from one of the heads of an upstream side of the transport direction of the heads for discharging color inks;

irradiating the pre-curing light to the background ink by one of the pre-curing light sources corresponding to the one of the heads that discharges the background ink;

discharging, from one of the heads for discharging color inks, a color ink on the pre-cured background ink; and irradiating the pre-curing light to the color ink by one of the pre-curing light sources corresponding to the one of the heads that discharges the color ink, wherein a second printing mode includes discharging a color ink from one of the heads for discharging color inks;

irradiating the pre-curing light to the color ink discharged in the in the second printing mode by one of the pre-curing light sources corresponding to the one of the heads that discharges the color ink in the second printing mode;

discharging the background ink on the color ink pre-cured in the second printing mode from one of the heads of a downstream side of the transport direction of the heads for discharging the color inks; and irradiating the pre-curing light to the background ink discharged in the second printing mode by one of the pre-curing light sources corresponding to the one of the heads that discharges the background ink in the second printing mode, and wherein irradiation energy of the light irradiated by the one of the pre-curing light sources corresponding to the one of the heads that discharges the background ink in the second printing mode is less than irradiation energy of the light irradiated by the one of the pre-curing light sources corresponding to the one of the heads that discharges the background ink in the first printing mode.

2. The printing device according to claim 1, wherein a plurality of detachably mounted cartridges is included as a plurality of cartridges for receiving inks cured by light irradiation, and the first printing mode or the second printing mode is selected according to replacement of each cartridge.

3. The printing device according to claim 2, wherein each of the plurality of cartridges includes a storage element for storing information about the type of the ink received therein.

4. The printing device according to claim 1, wherein the inks discharged by the plurality of heads are predefined with respect to every head.

5. The printing device according to claim 4, wherein:

the head that discharges the background ink in the first printing mode does not discharge the background ink in the second printing mode, and the head that discharges the background ink in the second printing mode does not discharge the background ink in the first printing mode.

6. The printing device according to claim 1, wherein the first printing mode is a mode for printing an image viewed from a printed surface side and the second printing mode is a mode for printing an image viewed from a medium side.

7. The printing device according to claim 1, wherein adjacent ones of the plurality of heads each have one of the plurality of pre-curing light sources provided therebetween.

8. The printing device according to claim 7, wherein the completely-curing light source is provided on a downstream side of a one of the plurality of heads positioned farthest down the downstream side of the transport direction.

9. The printing device according to claim 1, wherein each of the plurality of pre-curing light sources is configured to irradiate a same, predetermined value of irradiation energy.

10. The printing device according to claim 1, wherein each of the plurality of pre-curing light sources is configured to irradiate a value of irradiation energy based on a color of the discharged ink which the pre-curing light source is irradiating.

11. A printing method using a printing device including a plurality of heads configured to discharge inks cured by light irradiation and arranged in a transport direction of a medium, a plurality of pre-curing light sources provided in correspondence with the plurality of heads and configured to irradiate pre-curing light to dots formed on the medium by the heads, and a completely-curing light source configured to irradiate completely-curing light to the dots to which the light from the plurality of pre-curing light sources is irradiated, wherein a first printing mode includes discharging a background ink from one of the heads of an upstream side of the transport direction of the heads for discharging color inks;

irradiating the pre-curing light to the background ink by one of the pre-curing light sources corresponding to the one of the heads that discharges the background ink;

discharging, from one of the heads for discharging color inks, a color ink on the pre-cured background ink; and irradiating the pre-curing light to the color ink by one of the pre-curing light sources corresponding to the one of the heads that discharges the color ink, and wherein a second printing mode includes discharging a color ink from one of the heads for discharging color inks;

irradiating the pre-curing light to the color ink discharged in the in the second printing mode by one of the pre-curing light sources corresponding to the one of the heads that discharges the color ink in the second printing mode;

discharging the background ink on the color ink pre-cured in the second printing mode from one of the heads of a downstream side of the transport direction of the heads for discharging the color inks; and irradiating the pre-curing light to the background ink discharged in the second printing mode by one of the pre-curing light sources corresponding to the one of the heads that discharges the background ink in the second printing mode, and wherein irradiation energy of the light irradiated by the one of the pre-curing light sources corresponding to the one of the heads that discharges the background ink in the second printing mode is less than irradiation energy of the light irradiated by the one of the pre-curing light sources corresponding to the one of the heads that discharges the background ink in the first printing mode.

12. The printing method according to claim 11, wherein:

in the first printing mode, the background ink is not discharged from the head of the downstream side; and in the second printing mode, the background ink is not discharged from the head of the upstream side.

13. The printing method according to claim 11, wherein adjacent ones of the plurality of heads each have one of the plurality of pre-curing light sources provided therebetween.

14. The printing method according to claim 13, wherein the completely-curing light source is provided on a downstream side of a one of the plurality of heads positioned farthest down the downstream side of the transport direction.

15. The printing method according to claim 11, wherein each of the plurality of pre-curing light sources irradiates a same, predetermined value of irradiation energy.

16. The printing method according to claim 11, wherein each of the plurality of pre-curing light sources irradiates a value of irradiation energy based on a color of the discharged ink which the pre-curing light source is irradiating.

* * * * *